US007144281B2

(12) United States Patent
Maeda

(10) Patent No.: US 7,144,281 B2
(45) Date of Patent: Dec. 5, 2006

(54) FEMALE TERMINAL FITTING AND A BLANK FOR A PLURALITY OF TERMINAL FITTINGS

(75) Inventor: Taisaku Maeda, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 11/064,547

(22) Filed: Feb. 23, 2005

(65) Prior Publication Data

US 2005/0191912 A1 Sep. 1, 2005

(30) Foreign Application Priority Data

Feb. 26, 2004 (JP) ..... 2004-051765

(51) Int. Cl.
*H01R 11/22* (2006.01)
*H01R 13/11* (2006.01)

(52) U.S. Cl. ..... 439/852; 439/595

(58) Field of Classification Search ..... 439/852, 439/851, 595, 748, 845
See application file for complete search history.

(56) References Cited

U.S. PATENT DOCUMENTS 6,024,612 A * 2/2000 Myer et al. ..... 439/852
6,447,345 B1 * 9/2002 Sato et al. ..... 439/852
6,524,143 B1 * 2/2003 Chen ..... 439/852
6,736,684 B1 * 5/2004 Ishiyama ..... 439/852
6,971,927 B1 * 12/2005 Anbo et al. ..... 439/852
2001/0002350 A1 * 5/2001 Kashiyama et al. ..... 439/848
2005/0101198 A1 * 5/2005 Maeda ..... 439/852

FOREIGN PATENT DOCUMENTS

JP 8-306420 11/1996

* cited by examiner

*Primary Examiner*—Hae Moon Hyeon
(74) *Attorney, Agent, or Firm*—Gerald E. Hespos; Anthony J. Casella

(57) ABSTRACT

A female terminal fitting (10) is integrally formed by applying bending or the like to a metallic plate and provided with a main portion (20), a wire barrel (40) and an insulation barrel (50) in this order from front side to rear side. A cantilever-shaped resilient contact piece (70) that can be resiliently brought into contact with a male terminal fitting is resiliently deformably provided in the main portion (20). In a development obtained upon stamping the metallic plate out, the resilient contact piece (70) extends backward from the rear end edge of a ceiling wall (24) of the main portion (20) as a base end. The leading end of the resilient contact piece (70) is let to escape by an escaping recess (92) of a carrier (91).

7 Claims, 5 Drawing Sheets

FEMALE TERMINAL FITTING AND A BLANK FOR A PLURALITY OF TERMINAL FITTINGS

BACKGROUND OF THE INVENTION

1. Field of the Invention

The invention relates to a female terminal fitting and to a blank for forming a plurality of female terminal fittings.

2. Description of the Related Art

Japanese Unexamined Patent Publication No. H08-306420 and FIG. 5 herein show blanks that are stamped from a metallic plate for forming a female terminal fitting. With reference to FIG. 5, each blank has a bottom plate 1, two side plates 2 and a ceiling plate 3. A coupling 4 extends from the ceiling plate 3 and a contact piece 5 extends from the coupling 4. The blank is bent so that the bottom plate 1, the side plates 2 and the ceiling plate 3 form a rectangular tubular main portion 6. A barrel 7 is formed behind the main portion 6 and is configured to be crimped into connection with a wire. The contact piece 5 is cantilevered obliquely forward in the main portion 6 from a base end that is coupled to an end of the main portion 6 toward the barrel 7. The blanks are arranged side by side and are coupled to a lateral edge of a carrier 9 via a linking section 8 continuous with the rear end of the barrel 7.

The above-described female terminal fitting blank is wide because the coupling 4 and the resilient contact piece 5 are arranged side by side along the width direction at the outside of the lateral edge of the ceiling plate 3. This results in a poor use of the metal.

The resilient contact piece 5 could extend back from the rear end edge of the main portion 6. However, the linking section 8 then would have to be longer to provide a stamping margin between the leading end of the resilient contact piece 5 and the lateral edge of the carrier 9 to avoid interference between the resilient contact piece 5 and the carrier 9. The length of the female terminal fitting blank then increases by the elongation of the linking section 8, and the blank still is large.

The present invention was developed in view of the above problems and an object thereof is to improve blank cutout.

SUMMARY OF THE INVENTION

The invention relates to a female terminal fitting with a box-shaped main portion that has a front end with a terminal insertion opening for receiving a male terminal fitting. A resiliently deformable contact piece is formed in the main portion and is cantilevered toward the terminal insertion opening. A wire connection portion is behind the main portion and is configured for connection with a wire. The female terminal fittings are formed from blanks that are stamped from an electrically conductive plate. The blanks project substantially side-by-side from a lateral edge of a carrier so that each blank is supported only at one end. The main portion of each blank is farthest from the carrier and the resilient contact piece extends from the main portion towards the carrier. Thus, it is not necessary to elongate the link between the wire connection portion and the carrier, and blank cutout can be improved.

Escaping recesses preferably are formed at the lateral edge of the carrier for accommodating the leading ends of the resilient contact pieces.

The resilient contact piece preferably has a base end coupled to the rear end edge of the main portion. Thus, it is not necessary to use material outside the lateral edge of the main portion. Accordingly, the female terminal fitting blank can be narrowed to further improve the blank cutout.

The leading end of each resilient contact piece preferably is in the corresponding escaping recess. Thus, a part of the carrier can be used for forming the leading ends of the resilient contact pieces.

At least one engaging piece preferably bulges sideways from the resilient contact piece at a position near the tip and/or or towards the base end. The main portion is formed with at least one respective receiving portion for receiving the respective engaging piece to prevent an excessive deformation and/or undesired outward movement of the resilient contact piece.

The invention also relates to a blank for forming a plurality of the above-described female terminal fittings.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
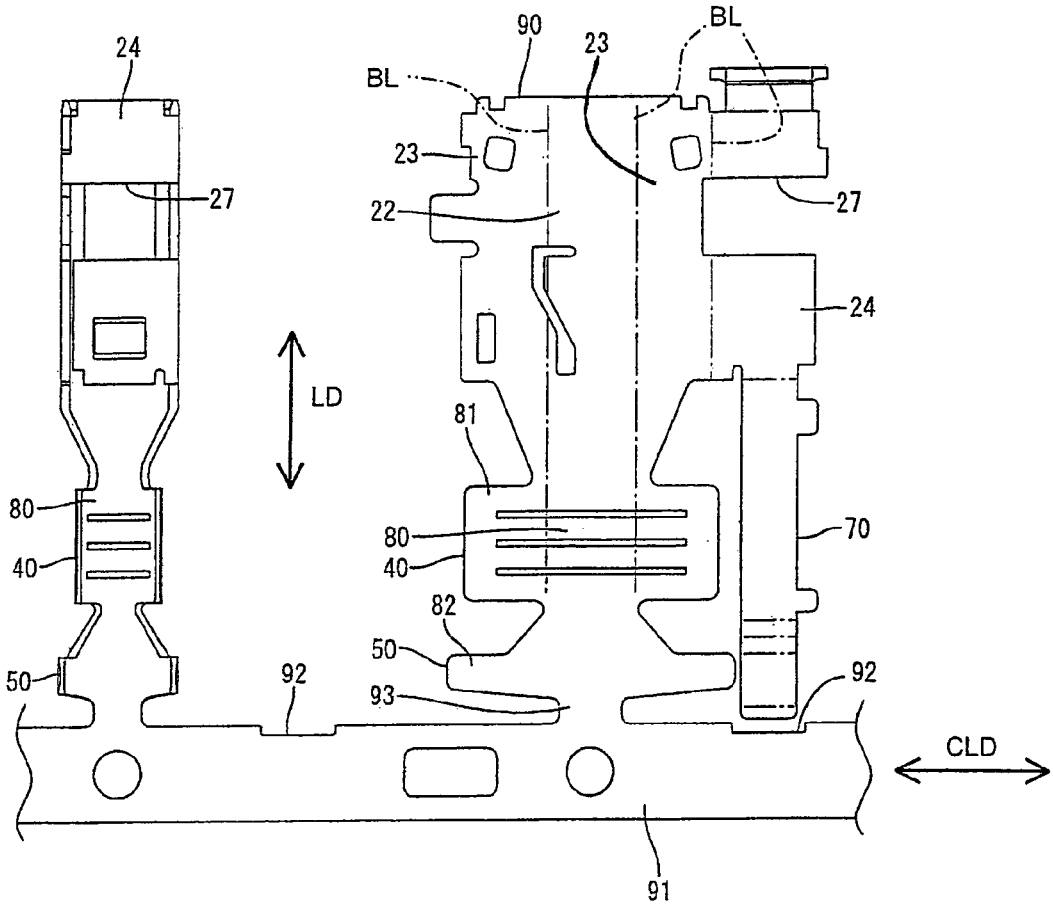
FIG. 1 is a development of a female terminal fitting according to one embodiment of the invention.
Figure 2:
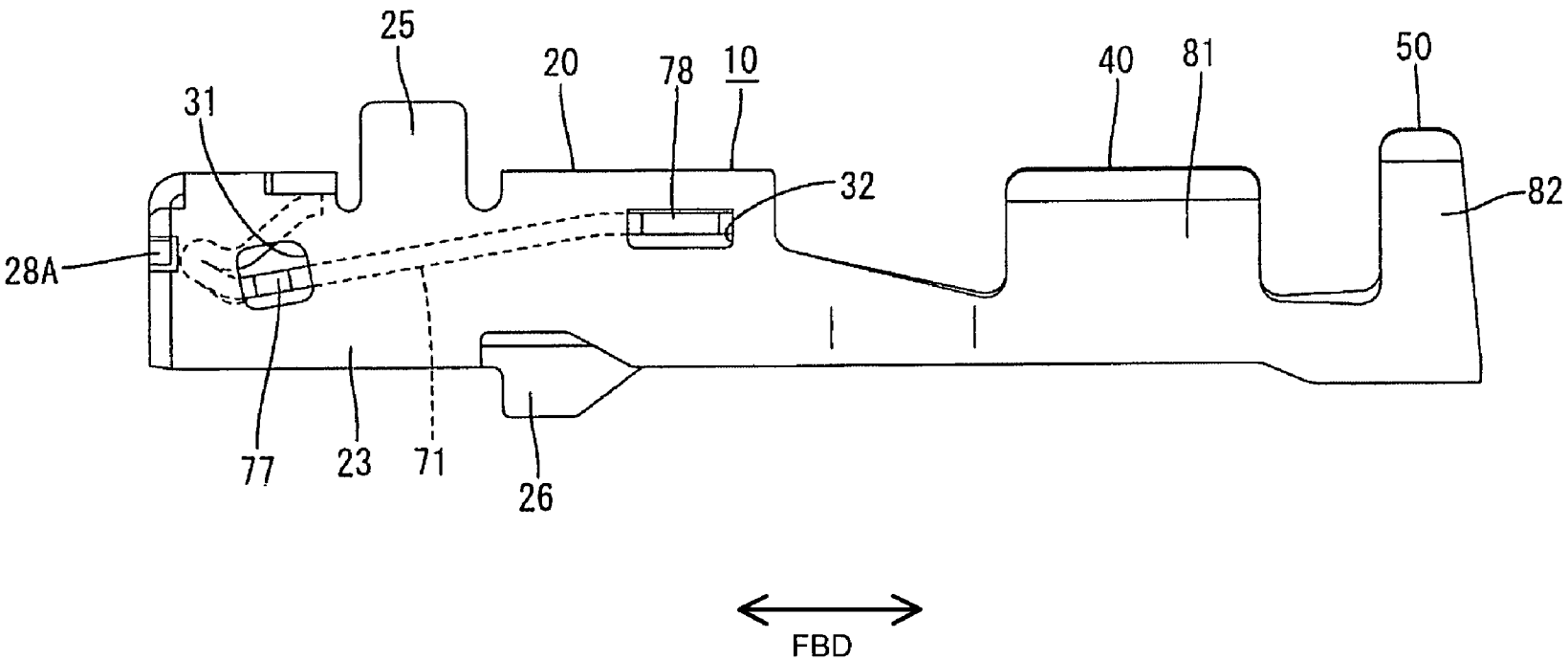
FIG. 2 is a side view of the female terminal fitting.

A female terminal fitting according to the invention is formed by stamping or cutting an electrically conductive metallic plate into the shape shown in FIG. 1, and then bending, folding and/or embossing the blank to form the female terminal fitting 10 shown in FIG. 2. The female terminal fitting 10 is narrow and long along forward and backward directions FBD. A main portion 20 is formed at a front end of the female terminal fitting 10 and a wire barrel 40 is provided behind the main portion 20. The wire barrel 40 is configured to be crimped, bent or folded into connection with a core of an unillustrated wire. An insulation barrel 50 is provided behind the wire barrel 40 and is configured to be crimped, bent or folded into connection with a rubber plug fit on the insulation coating of the wire.

Figure 4:
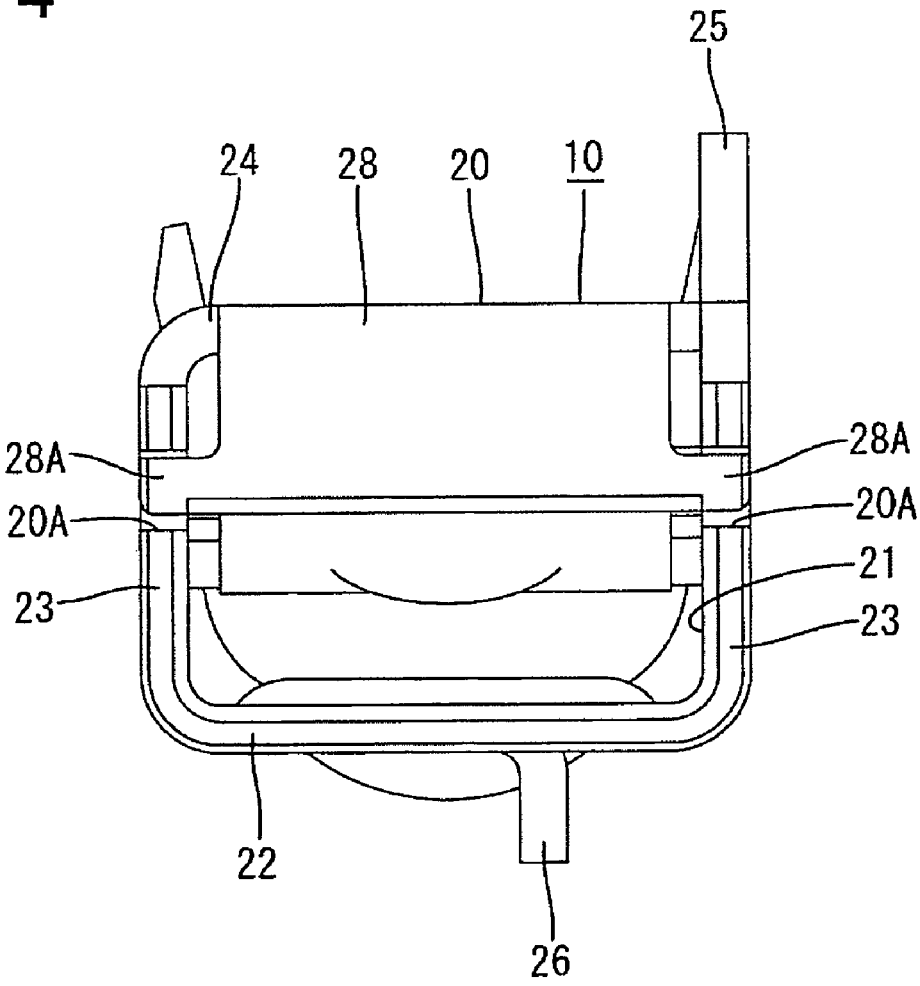
FIG. 4 is a front view of the female terminal fitting.
Figure 5:
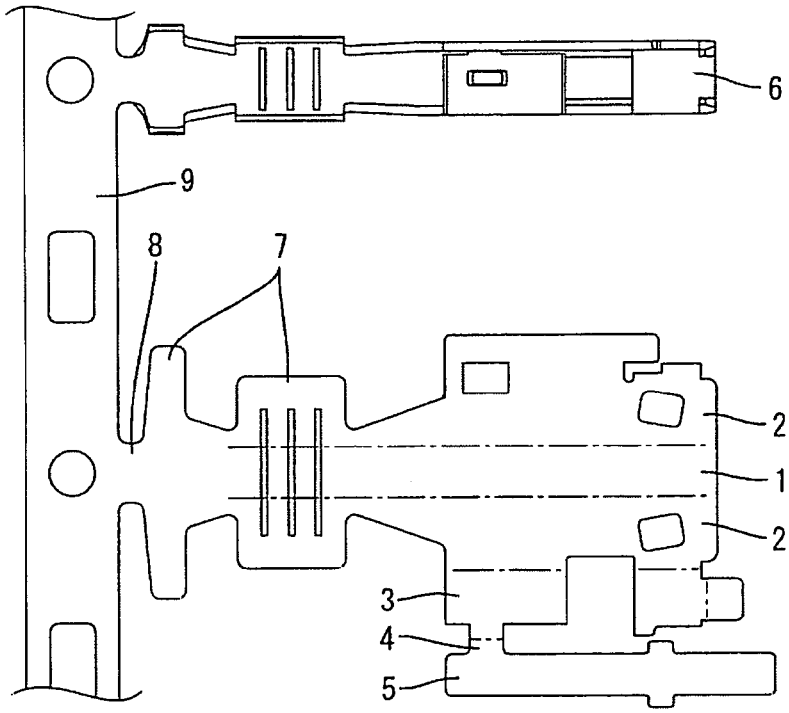
FIG. 5 PRIOR ART
FIG. 5 is a development of a prior art female terminal fitting.

The blank shown in FIG. 1 is bent along bending lines BL to form the substantially rectangular tubular main portion 20. A terminal insertion opening 21 is formed in the front surface of the main portion 20 and is configured to receive a tab of an unillustrated male terminal fitting. As shown in FIG. 4, the main portion 20 has a bottom wall 22. Two side walls 23 stand up from the opposite lateral edges of the bottom wall 22, and a ceiling wall 24 bridges the top extending ends of the side walls 23 to face the bottom wall 22. The terms top and bottom are used herein as a convenient frame of reference, but are not intended to imply a required gravitation orientation.

A stabilizer 25 projects up from the extending end of one of the side walls 23. The stabilizer 25 slides along a guiding groove in a cavity of an unillustrated connector housing when the female terminal fitting 10 is oriented properly. On the other hand, the stabilizer 25 prevents the female terminal fitting 10 from entering the cavity in an improper orientation. The bottom wall 22 is cut and bent to form a projection 26 that extends substantially along forward and backward directions FBD at a position displaced toward one side (right side in FIG. 4) from the middle. The projection 26 functions similar to the stabilizer 25 by stabilizing the posture of the female terminal fitting 10 and preventing an erroneous insertion.

Figure 3:
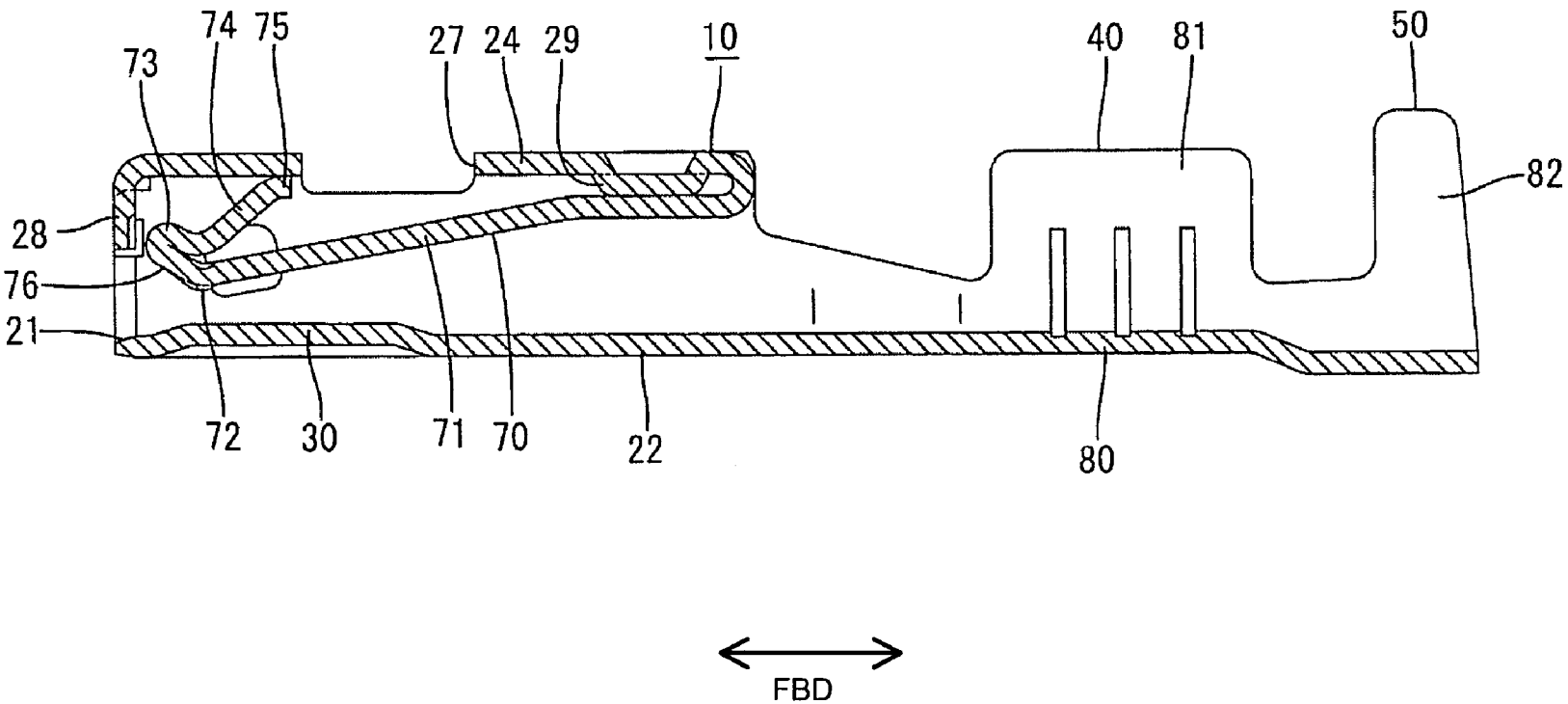
FIG. 3 is a section of the female terminal fitting.

A locking hole 27 is formed in the ceiling wall 24 at a side of the stabilizer 25. The locking hole27 divides the ceiling wall 24 into front and rear sections as shown in FIG. 3. A resiliently deflectable resin lock (not shown) is provided in the cavity of the connector housing and fits in the locking hole 27 to lock the female terminal fitting 10 in the cavity.

A front end of the ceiling wall 24 is bent at a substantially right angle toward the bottom wall 22 to form a protection wall 28 at the front of the main portion 20. The protection wall 28 partly closes the front end of the main portion 20, but leaves the terminal insertion opening 21. The protection wall 28 prevents entry of a tab in an improper insertion posture and prevents insertion of external matter into the main portion 20, thereby protecting the interior of the main portion 20. Two catches 28A bulge out sideways from the opposite lateral edges of the protection wall 28. The catches 28A engage notched recesses 20A at the opening edge of the main portion 20 to prevent deformation of the protection wall 28 e.g. upon a collision with the tab or the like.

A resilient contact piece 70 cantilevers forward from the rear end edge of the ceiling wall 24 of the main portion 20, as shown in FIG. 3. The resilient contact piece 70 has a tongue 71 that is coupled unitarily to the rear end edge of the main portion 20. A base end of the tongue 71 is folded at the rear end edge of the ceiling wall 24 to closely contact a base portion 29 embossed towards the inside of the main portion 20. The tongue 71 extends obliquely forward to a pointed contact 72 for contacting the tab. A folded portion 73 is folded back from the contact 72, and a leg 74 is coupled unitarily to the folded end of the folded portion 73. The leg 74 extends obliquely up and towards the back. A touching portion 75 is defined at the leading end of the leg 74 and contacts the inner surface of the ceiling wall 24. A spring force of the resilient contact piece 70 is received or generated by the touching portion 75. The folded portion 73 has a slanted surface 76 that is continuous with the contact 72 and substantially faces the terminal insertion opening 21. The slanted portion 76 is oblique to an inserting direction of the tab into the terminal insertion opening 21 and the outer end thereof is at a height substantially corresponding to the end of the protection wall 28. The slanted surface 76 contacts the leading end of a slightly misaligned tab to guide the tab to the contact 72.

The contact 72 has a convex surface embossed towards the bottom wall 22 and an insertion path for the tab is defined between the contact 72 and a protrusion 30 that projects from the bottom wall 22 towards the inside of the main portion 20. The space between the contact 72 of the resilient contact piece 70 in an unbiased state and the protrusion 30 is slightly less than the thickness of the tab. Accordingly, the tab is squeezed resiliently between the contact 72 and the protrusion 30 while the tongue portion 71 is deformed resiliently up.

Engaging pieces 77 bulge out sideways from the opposite lateral edges of the tongue 71 at a position near the tip as shown in FIG. 2. On the other hand, engaging holes 31 are formed in the side walls 23 at positions corresponding to the engaging pieces 77. The engaging pieces 77 normally fit loosely in the engaging holes 31. When the tongue portion 71 is deformed excessively, the engaging pieces 77 engage the walls of the engaging holes 31 to prevent further deformation. Further, locking pieces 78 bulge out sideways from the lateral edges of the tongue 71 towards the base end, and the side walls 23 are formed with locking holes 32 that receive the locking pieces 23 to prevent a lifting or outward movement of the tongue 71.

Each of the wire barrel 40 and the insulation barrel 50 has a bottom plate 80 extending back from and continuous with the bottom wall 22 and two crimping pieces 81, 82 project from the opposite lateral edges of the bottom plate 80. The respective crimping pieces 81, 82 are crimped, bent or folded into connection with the core and/or the insulation coating of the wire placed on or near or at the bottom plates 80 while being bent to wrap at least partly around the core and/or the insulation coating. The crimping pieces 82 of the insulation barrel 50 have a longer projecting distance from the lateral edges of the bottom wall 80 as compared to the crimping pieces 81 of the wire barrel 40.

The female terminal fitting 10 is formed preliminarily by stamping or cutting an electrically conductive metallic plate by a press. As shown in FIG. 1, a multitude of female terminal fitting blanks 90 are formed to project substantially side by side from the lateral edge of a long strip-shaped carrier 91 substantially within the thickness of the carrier 91 while being supported only at one side. Each female terminal fitting blank 90 is coupled to the carrier 91 via a link 93 that is continuous with the rear end of the insulation barrel 50 and projects substantially normal to the longitudinal direction CLD of the carrier 91 (i.e. the longitudinal direction LD of the blank is substantially normal to the longitudinal direction CLD of the carrier 91). Thereafter, bending, folding, embossing or the like is applied to the female terminal fitting blanks 90 to form the female terminal fittings 10. The female terminal fittings 10 then are fed to an unillustrated automated apparatus and are separated from the carrier 91 at positions coupled to the linking sections 93. If necessary, the terminal fittings 10 may be left coupled to the carrier (e.g. wound on a reel) to be separated therefrom before being processed further (such as crimped by an automatic crimping machine) e.g. at a mounting site.

The portion of the flat female terminal fitting blank 90 that will form the bottom wall 22 of the main portion 20 is located before the bottom plates 80 of the wire barrel 40 and the insulation barrel 50. Two side walls 23 are continuous with the opposite lateral edges of the bottom wall 22, the ceiling wall 24 is continuous with a lateral edge of one of the side walls 23, and the resilient contact piece 70 extends substantially straight back toward the carrier 91 from the rear end edge of the ceiling wall 24. Further, the crimping pieces 81, 82 project sideways from the opposite lateral edges of the bottom walls 80 of the wire barrel 40 and the insulation barrel 50 to face each other along the longitudinal direction LD of the blank 90. In other words, the resilient contact piece 70 extends from the ceiling wall 24 of the main portion 20 in a direction substantially normal to the longitudinal direction CLD of the carrier 91 and substantially parallel to the longitudinal direction LD of the terminal fitting 10.

The resilient contact piece 70 extends substantially normal to the longitudinal direction CLD of the carrier 91 while crossing an area outside of the leading ends of the crimping piece 81 of the wire barrel 40 and the crimping piece 82 of the insulation barrel 50. The lateral edge of the carrier 91 is formed with escaping recesses 92 and the leading end of each resilient contact piece 70 extends into one of the escaping recesses 92. As a result, a sufficient stamping margin is secured between the leading end of the resilient contact piece 70 and the lateral edge of the carrier 91 without elongating the link 93.

As described above, the leading end of the resilient contact piece 70 extends into the escaping recess 92 at the lateral edge of the carrier 91. Thus, the material can be saved to improve blank cutout.

The resilient contact piece 70 extends back towards the carrier 91 with the base end thereof coupled to the rear end edge of the ceiling wall 24 of the main portion 20. Thus, it is not necessary to use a material in an area outside the lateral edge of the ceiling wall 24, and the blank cutout is improved further by reducing the width of the female terminal fitting blank 90.

The resilient contact piece 70 could be longer than the aforementioned one. In this situation, a part of the carrier 91 can be used as the material for forming the leading end of the resilient contact piece 70 and the leading end of the resilient contact piece 70 can be located in the escaping recess 92. Thus, blank cutout can be improved even more.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

The contact is near the terminal insertion opening in the foregoing embodiment. However, the contact may be at a longitudinal intermediate position according to the invention.

The base end of the resilient contact piece is coupled to the rear end edge of the main portion in the foregoing embodiment. However, it may extend backward while being coupled to the lateral edge of the main portion according to the present invention.

In the foregoing embodiment, the resilient contact piece extends straight back from the rear end edge of the main portion in the development obtained by stamping or cutting the metallic plate. However, the resilient contact piece may extend obliquely back from the rear end edge of the main portion in the development obtained by stamping or cutting the metallic plate out.

What is claimed is:

1. A female terminal fitting, comprising:

a box-shaped main portion having opposite front and rear ends, a bottom wall extending between the front and rear ends, opposed first and second sidewalls extending up from opposite sides of the bottom wall and a top wall opposed to the bottom wall, the top wall extending from the first sidewall towards a top edge of the second sidewall, the front end of the main portion having a terminal insertion opening for receiving a mating male terminal fitting;

a wire connection portion extending unitarily rearward from the bottom wall at the rear end of the main portion to a rear end of the female terminal fitting and configured to be connected with a wire; and a resiliently deformable contact piece joined unitarily to the top wall at the rear end of the main portion and bent forwardly to cantilever into the main portion and towards the terminal insertion opening, the resiliently deformable contact piece being configured for contacting the male terminal fitting, the resilient contact piece having a length measured forward from the rear end of the main portion at least equal to a distance from the main portion to the rear end of the female terminal fitting.

2. The female terminal fitting of claim 1, wherein at least one engaging piece bulges out sideways from the resilient contact piece and the main portion is formed with at least one receiving portion for receiving the engaging piece to prevent excessive deformation and outward movement of the resilient contact piece.

3. A blank for forming a plurality of the female terminal fittings, comprising;

an elongated carrier having a side edge; and a plurality of female terminal fitting blanks projecting from the side edge of the carrier, each of said female terminal fitting blanks having a wire connection portion joined unitarily to the side edge of the carrier by a coupling, a bottom wall extending from an end of the wire connection portion farthest from the carrier, first and second sidewalls joined to opposite sides of the bottom wall, a top wall joined to the first sidewall and a resiliently deformable contact piece extending unitarily from the top wall back towards the carrier, wherein escaping recesses are formed in the side edge of the carrier at positions opposite leading ends of the resilient contact pieces for achieving sufficiently long resilient contact pieces while having short couplings.

4. The blank of claim 3, wherein the leading end of each resilient contact piece is located in the corresponding escaping recess.

5. The blank of claim 3, wherein the sidewalls are joined to the bottom wall along fold lines that are substantially perpendicular to the carrier, the top wall is joined to the first sidewall along a fold line substantially perpendicular to the carrier and the resilient contact piece is joined to the top wall along a fold line substantially parallel to the carrier.

6. The blank of claim 3, wherein at least one engaging piece bulges out sideways from the resilient contact piece and the sidewall is formed with at least one receiving portion configured for receiving the engaging piece.

7. The blank of claim 3, wherein the resilient contact piece is substantially adjacent the wire connection portion.

* * * * *